US008083238B2

(12) United States Patent
Borges

(10) Patent No.: US 8,083,238 B2
(45) Date of Patent: Dec. 27, 2011

(54) LIGHTING SYSTEM FOR SPORTING APPARATUS

(76) Inventor: Seth Borges, Beaverton, OR (US)

( * ) Notice: Subject to any disclaimer, the term of this patent is extended or adjusted under 35 U.S.C. 154(b) by 316 days.

(21) Appl. No.: 12/409,341

(22) Filed: Mar. 23, 2009

(65) Prior Publication Data

US 2009/0236841 A1 Sep. 24, 2009

Related U.S. Application Data

(60) Provisional application No. 61/038,684, filed on Mar. 21, 2008.

(51) Int. Cl.
*A63C 17/14* (2006.01)
*A63C 17/20* (2006.01)

(52) U.S. Cl. ..... 280/11.203; 280/600; 280/841; 280/87.042; 362/545; 362/555

(58) Field of Classification Search ..... 280/11.203, 280/600, 841, 87.042; 362/545, 555, 486
See application file for complete search history.

(56) References Cited

U.S. PATENT DOCUMENTS 4,991,066 A 2/1991 McCowan
4,997,196 A 3/1991 Wood
5,132,883 A * 7/1992 La Lumandier ..... 362/466
5,718,499 A * 2/1998 De Caro ..... 362/464
5,746,499 A * 5/1998 Ratcliffe et al. ..... 362/103
5,921,653 A * 7/1999 Chien ..... 362/103
6,345,834 B1 2/2002 Bianchini et al.
6,354,714 B1 * 3/2002 Rhodes ..... 362/153.1
6,431,733 B2 8/2002 Seifert et al.
6,540,384 B1 4/2003 Rosevear
6,621,419 B2 9/2003 Chiu
6,646,547 B2 11/2003 Chiu
6,802,636 B1 * 10/2004 Bailey, Jr. ..... 362/555
6,828,916 B2 * 12/2004 Rains et al. ..... 340/665
7,025,481 B2 * 4/2006 Moll ..... 362/487
7,048,284 B1 * 5/2006 Seifert ..... 280/79.11
7,232,243 B1 6/2007 Nassif
7,445,218 B2 * 11/2008 Esposito et al. ..... 280/87.042
7,708,289 B2 * 5/2010 Jaime, Sr. ..... 280/11.203
2004/0212980 A1 10/2004 Wells
2004/0257831 A1 12/2004 Liao
* cited by examiner

*Primary Examiner* — Toan To
(74) *Attorney, Agent, or Firm* — Marger Johnson & McCollom, P.C.

(57) ABSTRACT

Embodiments of the present invention provide a lighting system for a sporting apparatus. In one embodiment, a sporting board apparatus includes an elongated board structure having top surface, a bottom surface, and edge surfaces. The sporting board apparatus further includes a light system having a plurality of light sources coupled to a power supply. In addition, the sporting board apparatus may include a switching mechanism to control the supply of electrical power from the power supply to the light sources, and a select mechanism to control one or more light programs.

12 Claims, 4 Drawing Sheets

LIGHTING SYSTEM FOR SPORTING APPARATUS

RELATED APPLICATIONS

This application claims the benefit of priority to U.S. Provisional Patent Application No. 61/038,684 filed Mar. 21, 2008, entitled "LIGHTING SYSTEM FOR SPORTING APPARATUS," the contents of which are hereby incorporated by reference.

FIELD OF THE INVENTION

This disclosure relates generally to sporting apparatuses, and more particularly to sporting apparatuses having one or more light sources.

BACKGROUND

Board sports, i.e., sporting activities involving boards and riders are become increasingly popular. Part of the draw of these types of sporting activities is the gliding sensation associated with maneuvering the board or boards over a gliding medium. Additionally, the configuration of the boards often allows the participant to perform stunts, tricks, or jumps within the sporting activities.

With the rise in popularity of these activities, participants often look for ways to improve the performance and personalize the boards. Performance improvements conventionally seek to improve properties of the boards, such as strength, flexibility, or durability, or seek to improve the performance of the board in relationship to the medium on which the board travels. Personalization of the board often entails customizing graphics, board part colors, or board shape.

Although there are many possible graphic designs that can be implemented on a board apparatus and several dramatic colors to choose from with board parts, the differentiation between the customization efforts may not be large. That is, although two graphic designs may seem different upon close inspection, they may appear similar to a casual observer because of limited visible differences in the designs. For example, a red spider-web design on one sporting board may appear similar to a red shaded mountain on another sporting board.

Additionally, shape modification generally has limits associated with the functionality of the board. That is, drastic shape changes in the sporting board design may significantly decrease the performance of the board due to non-optimal structural features.

SUMMARY

Embodiments of the invention provide a lighting system for a sporting apparatus. In one embodiment, a sporting board apparatus includes an elongated board structure having top surface, a bottom surface, and edge surfaces. The sporting board apparatus further includes a light system having one or more light sources coupled to a power supply. In addition, the sporting board apparatus may include a switching mechanism to control the supply of electrical power from the power supply to the light sources, and may include other light controls, such as brightness, patterns, and timers.

DETAILED DESCRIPTION

Figure 1A:
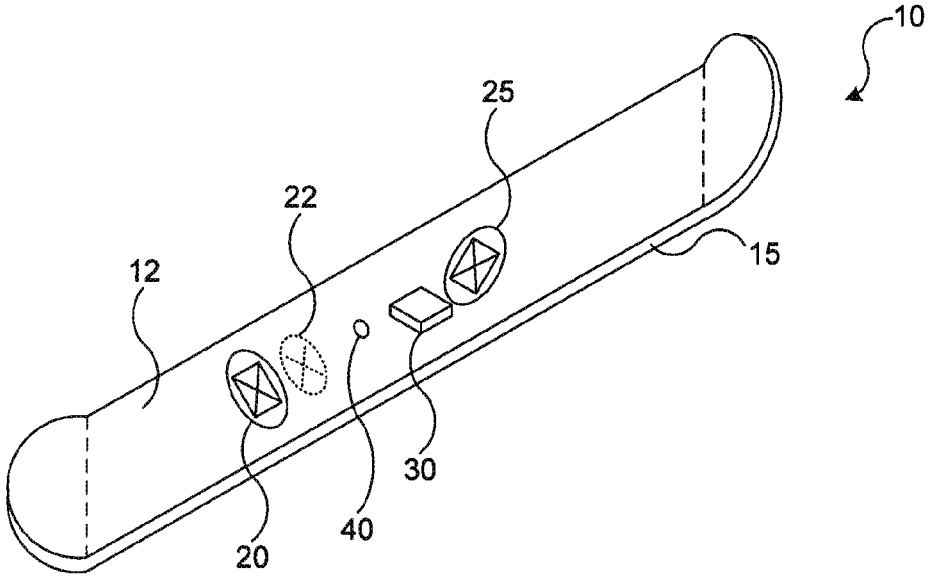
FIGS. 1A and 1B are isometric views of a sporting board apparatus according to embodiments of the invention.
Figure 1B:
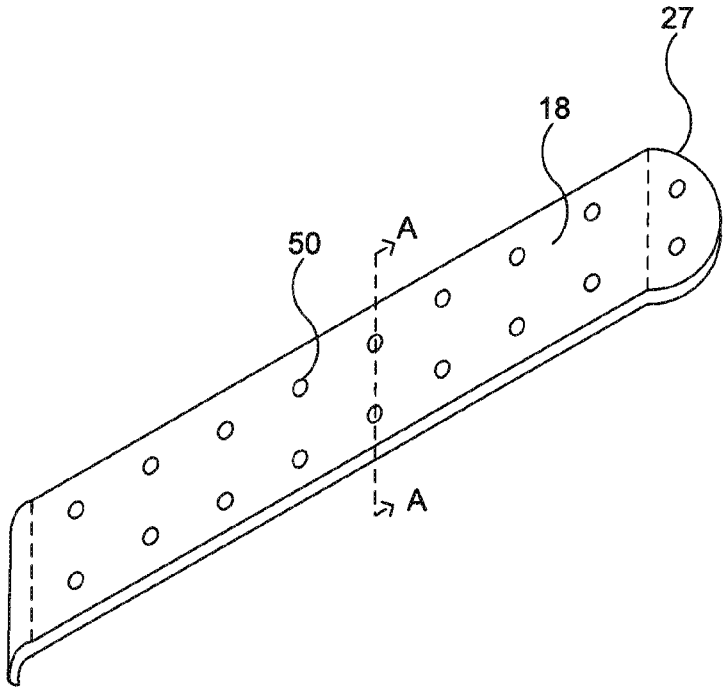

FIGS. 1A and 1B are isometric views of a sporting board apparatus according to embodiments of the invention. FIG. 1A is an isometric top view of a sporting apparatus, while FIG. 1B illustrates an isometric bottom view. In the embodiment shown in FIGS. 1A and 1B, the sporting apparatus is a snowboard. However, as discussed below with respect to FIG. 5, other embodiments of the invention are directed to other type of sporting apparatuses, and the invention is broad enough to cover all such apparatuses. Thus, while some references are made to features of a snowboard in the description, these features may not be present in other embodiments directed to different types of sporting apparatuses. Further, the sporting apparatuses of these other embodiments may include features not conventionally included on a snowboard.

Referring to FIGS. 1A and 1B, a snowboard 10 includes a top surface 12, a bottom surface 18, and edge surfaces 15. End portions 27 of the snowboard may be angled up from a normal line of the board body to keep the snowboard 10 traveling over a snow slope instead of becoming embedded in the slope. The snowboard 10 may include a rear binding 20 and a front binding 25 for attaching the boots of a participant to the snowboard 10. Because of the limited maneuverability of snowboards 10 on flat terrain at slow speeds, snowboarders generally remove their rear boot from the rear binding 20 when moving in lift lines and riding chair lifts. A stomp pad 22 may be provided between the front binding 25 and the rear binding 20 on the top surface 12 of the snowboard 10 to provide a location for the snowboarder to place the boot removed from the rear binding 20 when skating in a lift line or off a chair lift. Since the top surface 12 of the snowboard usually provides little traction for a snowboard boot, the stomp pad 22 may include a high friction surface so that a participant may better control the snowboard 10 during skating.

The snowboard 10 includes one or more light sources 50 configured to illuminate from the bottom surface 18 of the snowboard 10. These light sources 50 may include light emitting diodes (LEDs), electroluminescent layers, fiber optical sources, halogen light sources, lasers, filament based incandescent light sources, and other similar devices capable of emitting visible waves in the electromagnetic spectrum. LEDs may be preferable in some embodiments because of their comparatively long life cycles and their durability. Electroluminescent layers may be preferable in other embodiments because of comparatively small thickness required for the light source. In embodiments that include LEDs, the LEDs may be embedded in the snowboard 10 such that they do not protrude below the bottom surface 18 of the snowboard 10 and interfere with the performance of the snowboard 10. Because of their relatively thin profile, embodiments that include electroluminescent layers may have the electroluminescent layers formed on the bottom surface 18 of the snowboard 10. In these embodiments, a protective coating (not shown) may be formed over the layers on the bottom surface 18 of the snowboard 10 to protect the electroluminescent layers while maintaining the performance of the snowboard 10.

One or more light sources 40 may also be placed to illuminate from the top surface 12 of the snowboard. This upper light source 40 may allow a participant to quickly confirm that the lighting system on the snowboard 10 is working properly. Additionally, upper light sources 40 may provide additional design characteristics, and may provide a safety light partially illuminating the participant during night snowboarding. Although not shown in FIGS. 1A and 1B, additional lighting sources may be formed to illuminate from the edge portions 15 of the snowboard 10. Edge lighting sources may add further visibility of the board and its underlying medium. In addition, some of the plurality of bottom light sources 50 may be formed on the end portions 27 of the snowboard 10 that are angled upwardly. These lighting sources 50 may increase visibility of the board by other snowboarders and may provide some illumination of objects in front of the snowboard 10 during night snowboarding.

The lighting sources 40, 50 are coupled to a power supply 30, which provides power to the lighting system. The power supply 30 may be mounted to one of the bindings 20, 25 or to the top surface 12 of the snowboard 10, such that it is out of the way during operation of the snowboard 10. In other embodiments, the power supply 30 may be embedded in the snowboard 10 itself. The power supply 30 may include a waterproof housing and one or more remote power sources. These remote power sources may include batteries, such as alkali batteries, lithium ion batteries, nickel-metal hydride batteries, and similar known battery power sources. These power sources may be rechargeable or conventional single-use. In some embodiments, a solar panel may be include on a portion of the top surface 12 of the snowboard 10 to recharge or partially recharge the power supply 30. The power supply 30 may also include a switch or other control to regulate the power supplied to the light sources 40, 50.

Figure 2:
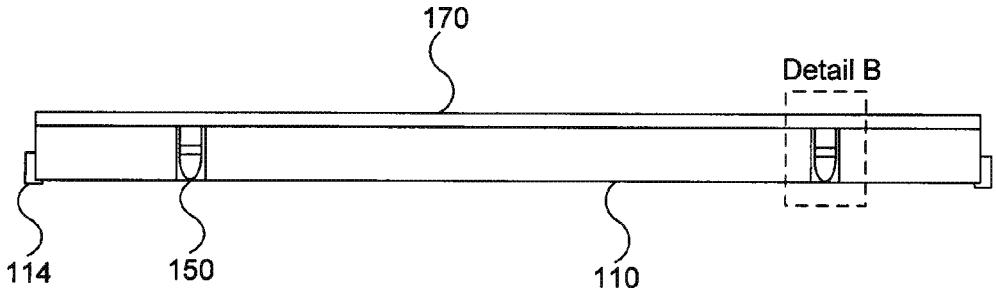
FIG. 2 is a sectional view taken along line A-A of the board apparatus shown in FIG. 1B.

FIG. 2 is a sectional view taken along line A-A of the board apparatus shown in FIG. 1B.

Referring to FIG. 2, the snowboard 110 includes metal edge portions 114 on the edges of the snow board. These metal edges 114 may be provided to help the snowboard 110 carve into hard snow and hold an edge during use. In the embodiment shown in FIG. 2, the snowboard includes bottom light sources 150 that are LEDs embedded in the snowboard 110. The LEDs 150 and the snowboard 110 are covered by a secondary top sheet 170 to protect the LEDs 150. This secondary top sheet 170 may be attached to the snowboard 110 by an adhesive, by mechanical means, or by a combination of an adhesive and mechanical means. Adhesives used in attaching the secondary top sheet 170 to the snowboard 110 may include epoxies, resins, double-sided waterproof tape, glues, and the like. Mechanical means used in attaching the secondary top sheet 170 to the snowboard 110 may include bolts fastened to threaded holes in the snowboard 110, rivets passing through the secondary top sheet 170 and the snowboard 110, removable threaded rivets, tacks, nails, screws, and the like. When mechanical attaching means are used to attach the secondary top sheet 170 to the snowboard 110, it may be preferable to include a waterproof sealing material or adhesive along edge portions of the snowboard 110 to prevent water from the snow from penetrating an opening between the secondary top sheet 170 and the snowboard 110. Both adhesives and mechanical attaching means are preferably also applied at edge portions of the snowboard 110 to prevent the secondary top sheet 170 from detaching from the snowboard 110.

The secondary top sheet 170 may include a polycarbonate layer, a polystyrene layer, a carbon fiber layer, a Kevlar layer, a fiberglass layer, a polymer layer, or other similar material layers. Polycarbonate layers may be substantially transparent, which may allow portions of graphics on the top surface of the snowboard 110 to show through the polycarbonate layer. Polystyrene layers may allow participants to create new graphics on the board by use of permanent markers or paint. Carbon fiber layers, Kevlar layers, and fiberglass layers may be lightweight and flexible. These types of layers may be set with a resin material to increase rigidity and be waterproof.

Figure 3:
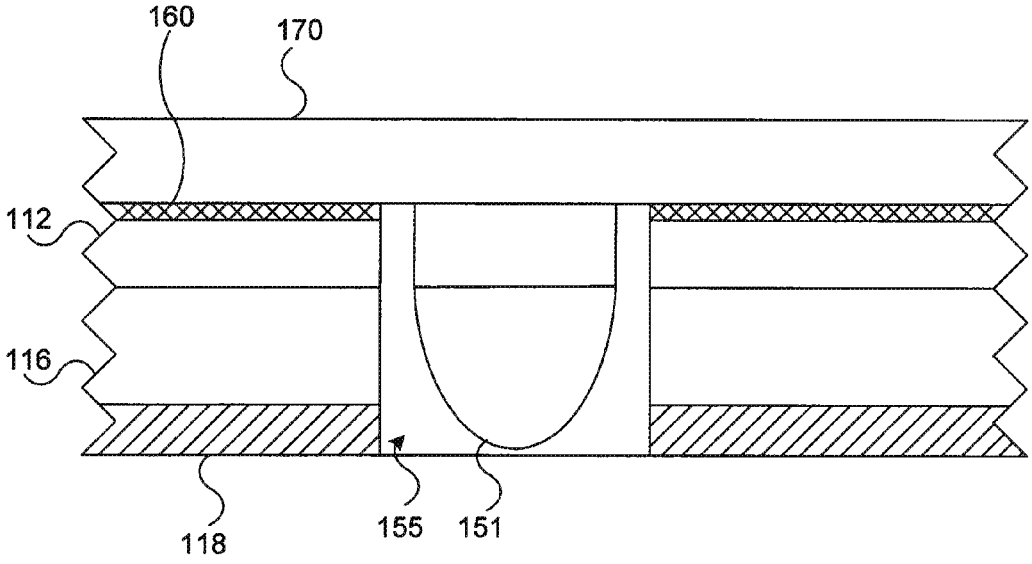
FIG. 3 is a detailed sectional view of detail B of the board apparatus shown in FIG. 2 according to embodiments of the invention.

FIG. 3 is a detailed sectional view of detail B of the board apparatus shown in FIG. 2 according to embodiments of the invention.

Referring to FIG. 3, the snowboard 110 includes a base layer 118, a core layer 116, and a top sheet layer 112. These layers may include materials used in conventional snowboards. For example, the base layer 118 may include polymer based material such as polyethylene, the core layer 116 may include wood or foam, and the top sheet layer 112 may include fiberglass.

The snowboard 110 may have an opening formed in the base layer 118, core layer 116, and top sheet layer 112 to house a light source 151. An electrical connector 160, such as wires or a bus is provided on top of the top sheet layer 112 and is electrically connected to the light source 151. The secondary top sheet 170 is disposed on the electrical connectors 160 and top sheet layer 112. As discussed above, the secondary top sheet 170 is attached to the snowboard 110 through an adhesive or mechanical means. The opening in the snowboard 110 that houses the light source 151 is filled with a sealing material 155, such as a resin or epoxy to seal the light source 151 in the opening. In other embodiments, the opening may be formed in more or fewer layers than illustrated in FIG. 3.

The secondary top sheet 170 may be part of a retrofit package that converts a conventional snowboard into an improved snowboard having a lighting system. That is, a conventional snowboard 110 may have a number of holes drilled through it, where the drill size roughly corresponds to the diameter of a light source 151. A corresponding number of light sources 151 are inserted into the drilled openings and are connected with an electrical connector 160. A secondary top sheet 170 is disposed over the electrical connectors 160 and attached to the snowboard 110 via a sealing adhesive and/or mechanical attaching means. A sealing material 155 is then disposed in the openings having the light sources 151 to seal the light sources 151. A power supply 30 (FIG. 1A), is then mounted on the secondary top sheet 170 and connected to the electrical connectors 160.

Figure 4:
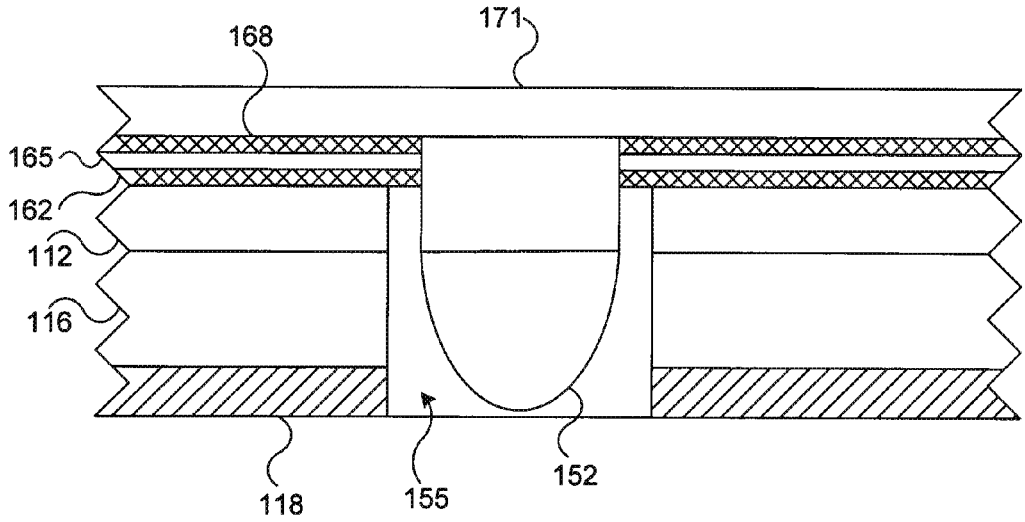
FIG. 4 is a detailed sectional view of detail B of the board apparatus shown in FIG. 2 according to embodiments of the invention.

FIG. 4 is a detailed sectional view of detail B of the board apparatus shown in FIG. 2 according to yet other embodiments of the invention.

The snowboard 110 of FIG. 4 includes a base layer 118, a core layer 116, and a top sheet layer 112 having an opening housing a light source 152. A sealing material 155 seals the opening housing the light source 152. A first conductive layer 162 is disposed on the top sheet layer 112. The first conductive layer 162 may include a strip of conductive material or a sheet of conductive material. A dielectric material 165 is disposed over the first conductive layer 162 to substantially cover the first conductive layer 162. A second conductive layer 168 is disposed over the dielectric material 165. Similar to the first conductive layer 162, the second conducive layer 168 may also include a strip of conductive material or a sheet of conductive material. A secondary top sheet layer 171 covers the second conductive layer 168. The first conductive layer 162 may be connected to one side of the power supply 30, while the second conductive layer 168 may be connected to the other side of the power supply 30. Effectively this makes each of the conductive layers 162, 168 into an electrical bus. The light source 152 is connected to each of the first and second conductive layers 162, 168, effectively being connected to the power supply bus, as well as a return path to the power supply. The first conductive layer 162 may be a power layer with a voltage supplied over the layer, while the second conductive layer 168 may be a ground layer, for instance. In other embodiments, the first conductive layer 162 may be the ground layer, while the second conductive layer 168 may be the power layer.

Embodiments utilizing the first and second conductive layers 162, 168 may be advantageous where the snowboards are manufactured to be modified with light sources 152. That is, the snowboards 110 may come pre-manufactured with first and second conductive sheets already included in the board structure. A participant could then drill holes in various locations on the board depending on personal preference, install light sources 152 into those openings, connect the light sources 152 to the first and second conductive layers exposed by the drill hole, and seal the drill hole with a resin or epoxy 155. In other embodiments, the secondary top sheet 171 may also be provided with the snowboard 110, so that the participant could attach the secondary top sheet 171 to the snowboard via predrilled and tapped holes in the snowboard 110 (for example) after installing the light sources 152 in desired locations. In these embodiments, the first and second conductive sheets 162 and 168 may preferably not be included near the binding attachment points to avoid short circuits.

Figure 5:
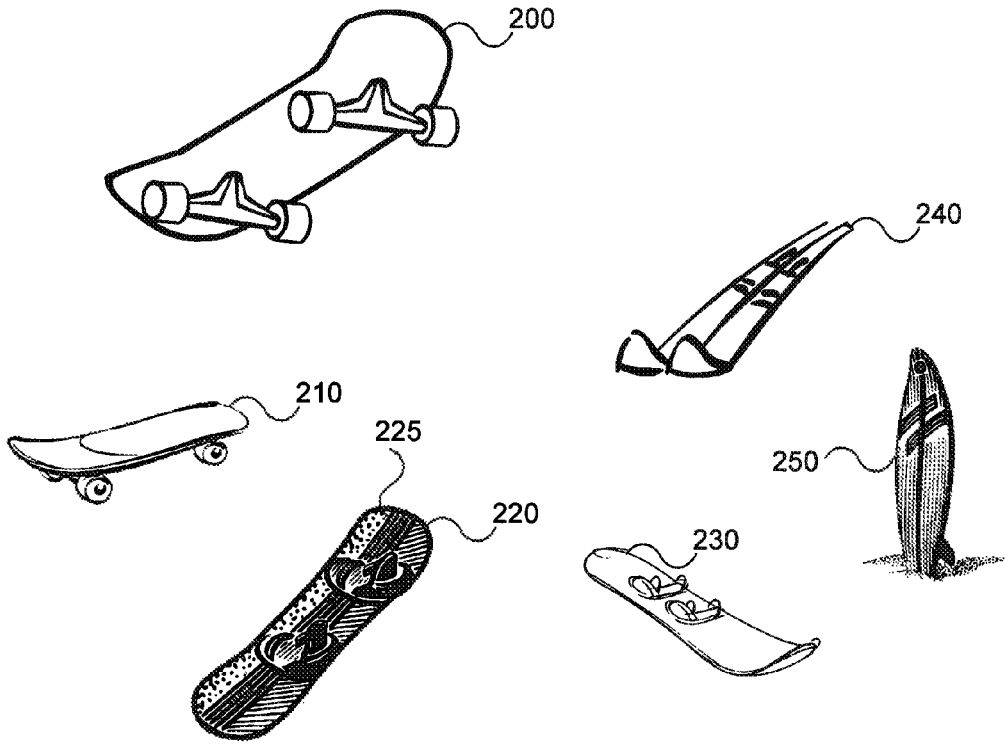
FIG. 5 is a diagram of exemplary types of sporting board apparatuses according to embodiments of the invention.

FIG. 5 is a diagram of exemplary types of sporting board apparatuses according to embodiments of the invention.

Referring to FIG. 5, various other types of sporting apparatuses are shown that may incorporate embodiments of the lighting system discussed in this disclosure. These sporting apparatuses may include one or more boards. For example, skateboards 200, 210 may utilize a lighting system similar to the ones described above. However, since substantially all of the top surface of skateboards are stood upon or grabbed in tricks, a power supply would preferably be mounted within the skate deck or below the skate deck.

Skyboards 230 used by sky divers may also be modified with a lighting system. Such a lighting system would enable the skyboarders to be more visible from the ground and may allow several skyboarders to form various patterns visible from the ground below. Sandboards 220 used by participants on sand dunes or other angled walls of sand may use a lighting system to illuminate portions of the sandboards 220. These may include electroluminescent strips 225 on the top surface of the sandboards 220. Skis 240 may also utilize a lighting system on one or both skis. In embodiments where both skis include light sources, each ski may have a separate power supply to avoid connection problems. Surfboards 250 may also have a similar lighting system used during night surfing.

Figure 6:
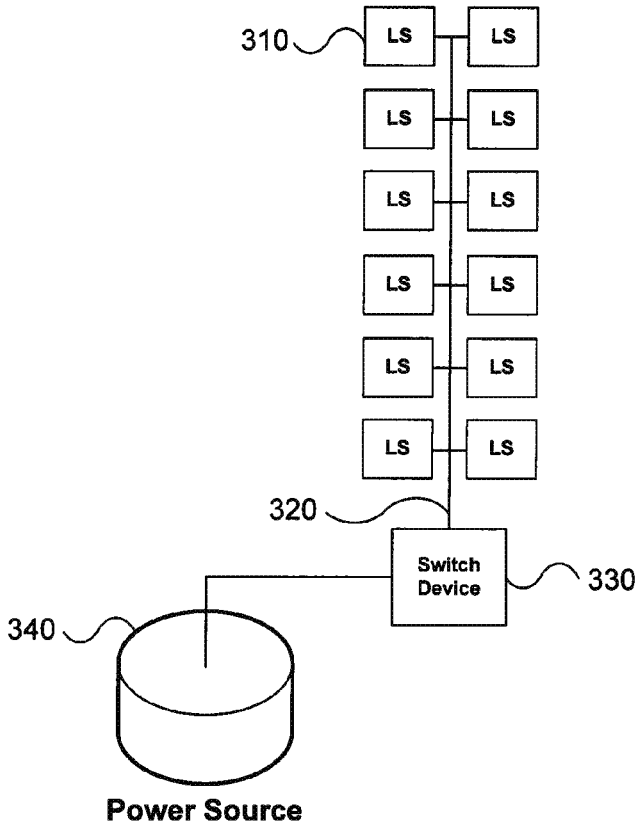
FIG. 6 is a functional block diagram of a lighting system according to embodiments of the invention.

FIG. 6 is a functional block diagram of a lighting system according to embodiments of the invention.

Referring to FIG. 6, a lighting system for a sporting apparatus may include a plurality of light sources ("LS") 310 coupled to a power source 340 through an electrical connection 320. The electrical connection 320 may be an electrical wire or the electrical bus as described above, for instance. A switch device 330 may be provided between the light sources 310 and the power source 340 to control the power supplied to the light sources 330. In some embodiments, the switch device 330 may be a two position device that either allows power to flow to the light sources (i.e., an 'on' position) or prevents power from flowing to the light sources 310 (i.e., an 'off' position). In other embodiments, the switch device may have a multitude of positions and/or variable voltage circuitry to control the amount and timing of power provided to the light sources, and hence the brightness of the light sources.

Figure 7:
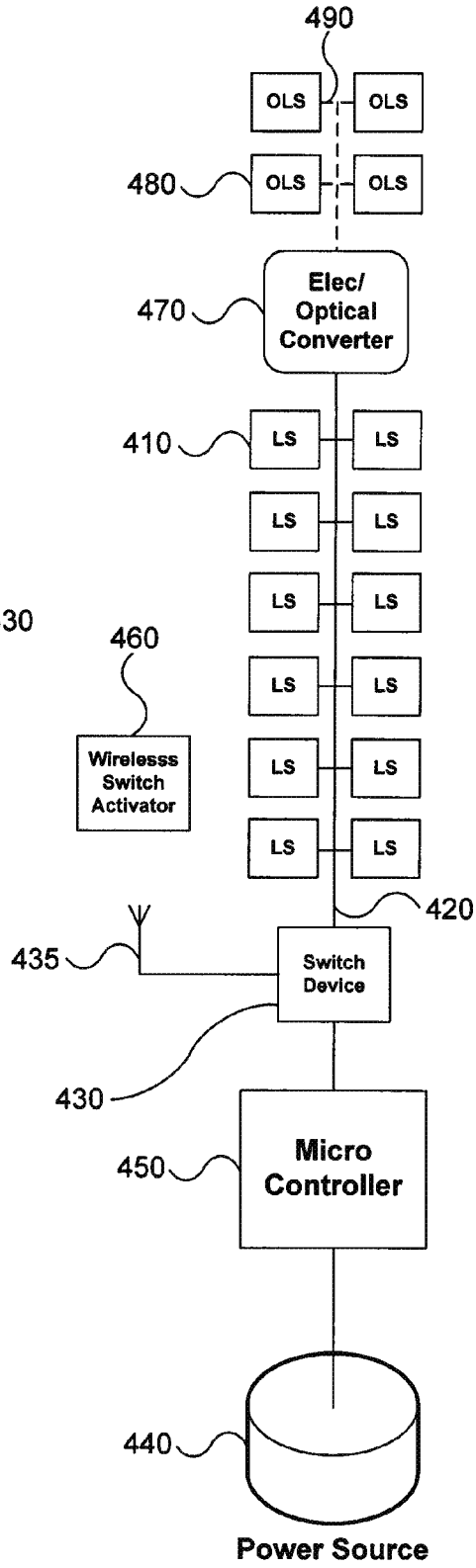
FIG. 7 is another functional block diagram of a lighting system according to embodiments of the invention.

FIG. 7 is another functional block diagram of a lighting system according to embodiments of the invention.

Referring to FIG. 7, a lighting system for a sporting apparatus may include a plurality of light sources ("LS") 410 coupled to a power source 440 and a microcontroller 450 through an electrical connection 420. Optical light sources ("OLS") 490 may be further connected to the electrical connector 420 through an electrical to optical converter 470 and fiber optic connections 490. A switch device 430 may be provided between the light sources 410, 480 and the power source 440 to control the power supplied to the light sources 410, 480. The switch device 430 may also include an antenna 435 to receive signals from a wireless switch activator or remote control 460. This remote control 460 may be kept in the pocket of a participant and be used to quickly and easily turn on or off the light sources 410, 480. The switch device 430 may also be controlled by signals from the microcontroller 450.

The microcontroller 450 may include a processor and memory (not shown), or may be a custom controller circuit. The microcontroller may control lighting sequences or light appearances for the light sources 410, 480. For example, the microcontroller 450 may determine a blink rate for the light sources 410, 480, generate a timed scrolling effect, or control the light sources 410, 480 to show symbols, letters, or words when viewed by an observer. The light sources 410, 480 may each be given a unique address so that they may be individually controlled by the microcontroller 450. In one embodiment, a portion of the light sources 410, 480 may be LEDs of a first color while another portion of the light sources 410, 480 may be LEDs of a second color, where the microcontroller 450 controls the light sources 410, 480 such that the first and second colored LEDs alternatively blink on and off.

The microcontroller 450 may be programmed to create various lighting effects with the light sources 410, 480. The microcontroller may include an external port (not shown) to connect with a personal computer or computer network, such as the internet. The microcontroller may also include a wireless antenna, an IR port, or a Bluetooth port for communicating with a remote computer. Lighting effect instructions may be downloaded to the microcontroller 450 from a device, such as a computer and stored in memory. Running the instructions then causes the desired patterns or signals to be displayed by the lighting system. Additionally, the microcontroller 450 may store multiple sequences that can be selected by the operator using the switch device 430, wireless switch activator 460, or another mechanism.

The microcontroller 450 may also be associated with various other components to ensure the safety of the participant. For example, the microcontroller 450 may include a GPS unit and/or an avalanche transponder to help locate a lost participant or a participant involved in an avalanche. The GPS unit and avalanche transponder may be separate components housed in the same waterproof housing as the microcontroller 450 and powered by the power source 440. However, in other embodiments, the microcontroller 450 may include GPS and transponding functionality.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A snowboard comprising:

a core layer having an upper surface and a lower surface;

a base layer formed on the lower surface of the core layer;

a first top sheet layer formed on the upper surface of the core layer;

a plurality of openings extending through the core layer and first top sheet layer, the plurality of openings at least partially extending through the base layer;

a plurality of light sources inserted in the plurality of openings, wherein the light sources are configured to illuminate from a bottom surface of the snowboard;

a power supply;

an electrical connector formed over the first top sheet layer, the electrical connector configured to connect the light sources to the power supply;

a second top sheet formed over the electrical connector and first top sheet; and a sealing material formed in the openings and surrounding the light sources.

2. The snowboard of claim 1, further comprising a switch device coupled to the electrical connector between the power supply and light sources, the switch device configured to include at least an off position and an on position.

3. The snowboard of claim 2, wherein the switch device includes an antenna configured to receive wireless signals for alternating the switch device between the on and off positions.

4. The snowboard of claim 2, wherein the switch device is configured to alternate between the on and off positions in response to a rider input to a stomp pad mounted on the second top sheet.

5. The snowboard of claim 1, further comprising a microcontroller coupled to the electrical connector, the microcontroller configured to control illumination among the light sources.

6. The snowboard of claim 5, wherein the microcontroller is configured to control at least one of a blink rate for the light sources, a pattern display function for illuminating a portion of the light sources, or a timing function for illuminating the light sources.

7. The snowboard of claim 1, wherein the electrical connector includes a first conductive layer, a second conductive layer, and a dielectric layer formed between the first and second conductive layers.

8. A method of retrofitting a snowboard with a light package, the method comprising:

forming a plurality of holes in the snowboard;

inserting light sources in the holes formed in the snowboard, the light sources inserted to illuminate from a bottom surface of the snowboard;

connecting the light sources with an electrical connector, the electrical connector formed on a top surface of the snowboard;

filling the holes with a sealing material to surround the light sources;

attaching a secondary top sheet on the top surface of the snowboard to cover the holes and electrical connector;

mounting a power source on the secondary top sheet; and connecting the power sources to the electrical connector.

9. The method of claim 8, wherein the secondary top sheet is attached to the top surface of the snowboard by an adhesive.

10. The method of claim 8, wherein the secondary top sheet is attached to the top surface of the snowboard by an adhesive and mechanical means.

11. The method of claim 8, wherein the holes formed in the snowboard are substantially the same diameter as the respective light sources.

12. The method of claim 8, further comprising attaching bindings and a stomp pad to the secondary top sheet.

* * * * *